US010012194B2

(12) United States Patent
Sato et al.

(10) Patent No.: US 10,012,194 B2
(45) Date of Patent: Jul. 3, 2018

(54) FUEL INJECTION VALVE WITH CYLINDER INTERNAL PRESSURE SENSOR

(71) Applicant: KEIHIN CORPORATION, Tokyo (JP)

(72) Inventors: Gaku Sato, Utsunomiya (JP); Keisuke Machida, Sakura (JP); Kenichi Yoshimura, Sakura (JP); Koji Suzuki, Utsunomiya (JP)

(73) Assignee: KEIHIN CORPORATION, Tokyo (JP)

( * ) Notice: Subject to any disclaimer, the term of this patent is extended or adjusted under 35 U.S.C. 154(b) by 167 days.

(21) Appl. No.: 14/970,900

(22) Filed: Dec. 16, 2015

(65) Prior Publication Data

US 2016/0208754 A1 Jul. 21, 2016

(30) Foreign Application Priority Data

Jan. 20, 2015 (JP) ..... 2015-008429

(51) Int. Cl.
*F02M 57/00* (2006.01)
*F02M 51/00* (2006.01)

(52) U.S. Cl.
CPC ..... *F02M 57/005* (2013.01); *F02M 51/005* (2013.01); *F02M 2200/247* (2013.01)

(58) Field of Classification Search
CPC ..... F02M 2200/247; F02M 51/005; F02M 57/005; F02D 2041/281; F02D 2041/285; F02D 2400/18; F02D 35/023; F02D 41/28
See application file for complete search history.

(56) References Cited

U.S. PATENT DOCUMENTS 6,570,304 B1 5/2003 Okazaki
6,729,297 B2 * 5/2004 Futonagane ..... F02D 41/3836 123/294
7,305,972 B2 * 12/2007 Kloos ..... F02D 41/008 123/479
9,127,612 B2 * 9/2015 Nakata ..... F02D 41/2467
(Continued)

FOREIGN PATENT DOCUMENTS

JP 09-053483 2/1997

OTHER PUBLICATIONS

This application is co-pending with U.S. Appl. No. 14/970,893, filed Dec. 16, 2015, U.S. Appl. No. 14/970,905, filed Dec. 16, 2015, and U.S. Appl. No. 14/997,703, filed Jan. 18, 2016.
(Continued)

*Primary Examiner* — Sizo Vilakazi
(74) *Attorney, Agent, or Firm* — Rankin, Hill & Clark LLP

(57) ABSTRACT

In the interior of a resin mold portion that constitutes a fuel injection valve, an amplifying member to which a power source terminal and a signal terminal are connected, is provided. A signal transmitting unit, which outputs a detection signal from a sensor, is connected electrically to a substrate of the amplifying member. Further, the amplifying member is molded integrally when the resin mold portion is formed. In addition, a pressure inside a combustion chamber of an internal combustion engine, which is detected by the sensor, is output through the signal transmitting unit to the amplifying member, is amplified by the amplifying member, and is output externally from the signal terminal.

2 Claims, 4 Drawing Sheets

(56) References Cited

U.S. PATENT DOCUMENTS

| | | | | |
|---|---|---|---|---|
| 2003/0154956 | A1* | 8/2003 | Eckerle | F02D 41/00 123/357 |
| 2005/0211214 | A1 | 9/2005 | Tomita | |
| 2009/0056676 | A1* | 3/2009 | Nakata | F02D 41/221 123/478 |
| 2009/0056678 | A1* | 3/2009 | Nakata | F02D 41/221 123/480 |
| 2010/0050991 | A1 | 3/2010 | Cooke | |
| 2011/0224885 | A1 | 9/2011 | Ohata | |
| 2014/0048041 | A1* | 2/2014 | Akazaki | F02D 35/023 123/445 |
| 2014/0316646 | A1* | 10/2014 | Kaneko | F02M 57/005 701/34.4 |
| 2015/0059699 | A1 | 3/2015 | Sato | |
| 2015/0152824 | A1 | 6/2015 | Akazaki et al. | |
| 2016/0208729 | A1* | 7/2016 | Sato | F02M 51/005 |
| 2016/0208753 | A1* | 7/2016 | Sato | F02M 57/005 |
| 2016/0222892 | A1 | 8/2016 | Akazaki et al. | |
| 2017/0009688 | A1* | 1/2017 | Okunishi | F02D 41/1486 |

OTHER PUBLICATIONS

U.S. Office Action dated Apr. 14, 2017 in U.S. Appl. No. 14/997,703, filed Jan. 18, 2016, 15 pages.
U.S. Office Action dated Jun. 28, 2017 in U.S. Appl. No. 14/970,905, filed Dec. 16, 2015, 17 pages.
U.S. Office Action from co-pending U.S. Appl. No. 14/970,893, dated Feb. 22, 2018, 35 pages.
U.S. Office Action dated Sep. 26, 2017 from copending U.S. Appl. No. 14/997,703, 11 pages.

* cited by examiner

FUEL INJECTION VALVE WITH CYLINDER INTERNAL PRESSURE SENSOR

CROSS-REFERENCE TO RELATED APPLICATION

This application is based upon and claims the benefit of priority from Japanese Patent Application No. 2015-008429 filed on Jan. 20, 2015, the contents of which are incorporated herein by reference.

BACKGROUND OF THE INVENTION

Field of the Invention

The present invention relates to a fuel injection valve equipped with a cylinder internal pressure sensor, the sensor being capable of detecting a cylinder internal pressure in the interior of a combustion chamber, the fuel injection valve being used in a direct injection type internal combustion engine in which fuel is injected directly into the combustion chamber in the internal combustion engine.

Description of the Related Art

Heretofore, for example, as disclosed in Japanese Laid-Open Patent Publication No. 09-053483, with the aim of detecting a cylinder internal pressure of a combustion chamber in an internal combustion engine, it has been known to attach an internal pressure sensor to an end of a fuel injection valve. The internal pressure sensor is arranged between the end of the fuel injection valve and an attachment hole of a cylinder head that makes up the internal combustion engine. A lead line for transmitting to the exterior the detected cylinder internal pressure as an output signal is connected to the internal pressure sensor. In addition, the lead line is connected, for example, to an electronic control unit, whereby a control or the like is performed based on the cylinder internal pressure by outputting the cylinder internal pressure as an output signal to the electronic control unit.

SUMMARY OF THE INVENTION

However, with the above-described internal pressure sensor that is mounted on the fuel injection valve, the lead line, which is connected to the internal pressure sensor and the electronic control unit, is exposed to the exterior of the fuel injection valve. Therefore, in an assembled condition, or when the internal pressure sensor is attached to the cylinder head together with the fuel injection valve, there is a concern that a disconnection may occur as a result of loads that are applied with respect to the lead line, and that detection of the cylinder internal pressure cannot be performed due to such a disconnection.

Further, since the internal pressure sensor is arranged in contact with the cylinder head, it is easy for noise caused by vibrations or the like of the internal combustion engine to be generated, thus making it difficult to read out with high accuracy the detection value that is detected by the internal pressure sensor.

A general object of the present invention is to provide a fuel injection valve equipped with a cylinder internal pressure sensor, which protects a signal transmitting unit that transmits an output from the sensor, together with enabling an increase in detection accuracy.

The present invention is characterized by a fuel injection valve equipped with a cylinder internal pressure sensor, the fuel injection valve being configured to directly inject fuel into a combustion chamber of an internal combustion engine, the sensor being provided at an end of the fuel injection valve, the sensor being configured to detect a cylinder internal pressure in the interior of the combustion chamber, the fuel injection valve including a signal transmitting unit disposed in the interior of the fuel injection valve and configured to transmit a detection signal based on the cylinder internal pressure. The signal transmitting unit contains a first transmitting member connected to the sensor, a second transmitting member connected to the first transmitting member and configured to externally output the detection signal, and an amplifying unit disposed on the first transmitting member and configured to amplify the detection signal.

According to the present invention, in the fuel injection valve equipped with the cylinder internal pressure sensor that detects a cylinder internal pressure in the interior of a combustion chamber, the signal transmitting unit is provided which transmits a detection signal detected by the sensor, and the amplifying unit for amplifying the detection signal is disposed on the first transmitting member of the signal transmitting unit which is connected to the sensor.

Consequently, even in the case that noise is generated due to vibrations or the like of the internal combustion engine, it is possible for the detection signal in which noise is comparatively small to be amplified by the amplifying unit at a position near to the sensor, and a highly accurate detection signal can be obtained. Further, by disposing the signal transmitting unit including the amplifying unit in the interior of the housing, the signal transmitting unit can be protected, in contradistinction to the conventional fuel injection valve in which the wiring connected to the sensor is arranged on the exterior of the fuel injection valve.

The above and other objects, features and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Figure 1:
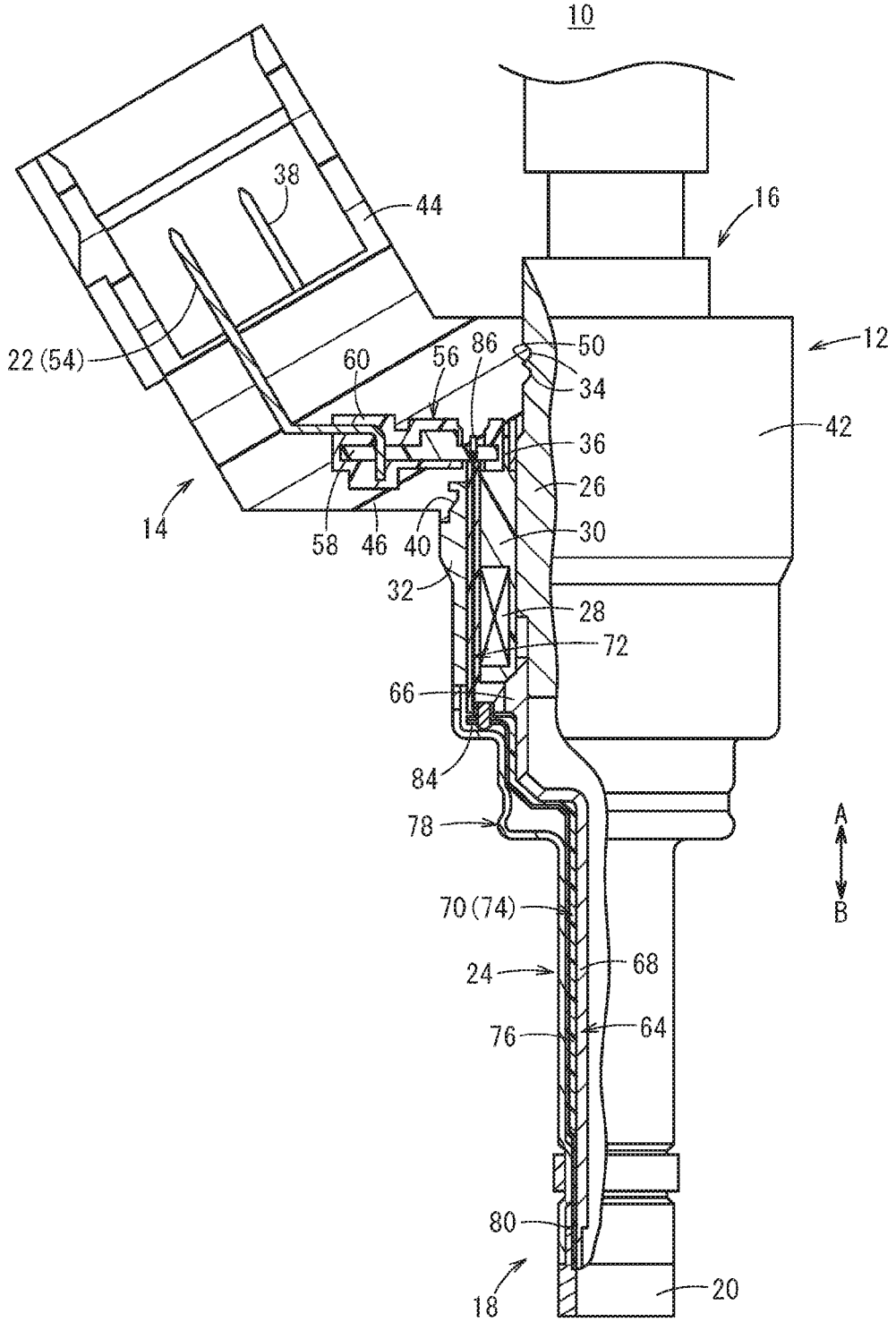
FIG. 1 is an overall front view, partially shown in cross section, of a fuel injection valve equipped with a cylinder internal pressure sensor according to an embodiment of the present invention.

As shown in FIG. 1, a fuel injection valve 10 equipped with a cylinder internal pressure sensor (hereinafter referred to simply as a fuel injection valve 10) includes a housing 12, a resin mold portion (resin sealing portion) 14 provided on an outer circumferential side of the housing 12, a fuel supply unit 16 disposed on a proximal end of the housing 12 and to which fuel is supplied, a fuel injector 18 disposed on a distal end of the housing 12, a sensor 20 mounted on a distal end of the fuel injector 18, and a signal transmitting unit 24 that electrically interconnects the sensor 20 and a signal terminal (second transmitting member) 22 connected to a non-illustrated electronic control unit (ECU) and thereby transmits output signals therebetween.

Below, the side of the fuel supply unit 16 in the fuel injection valve 10 will be referred to as a proximal end side (in the direction of the arrow A), and the side of the fuel injector 18 will be referred to as a distal end side (in the direction of the arrow B).

The housing 12, for example, is constituted as a solenoid unit that drives the fuel injection valve 10. The housing 12 includes a fixed core 26 that is disposed in the center thereof, a bobbin 30 that is provided on an outer circumferential side of the fixed core 26 and retains a coil 28, a cylindrical holder 32 disposed further on a distal end outer circumferential side of the bobbin 30, and a movable core (not shown) that is displaced under a magnetically excited action of the coil 28.

The fixed core 26 extends further to the proximal end side (in the direction of the arrow A) of the housing 12 with respect to the proximal end of the holder 32, and is arranged in the center of the later-described resin mold portion 14. Annular first grooves 34, which are engaged with the later-described resin mold portion 14, are formed on the outer circumferential surface of the fixed core 26. Further, the fuel supply unit 16 is disposed on the proximal end side of the fixed core 26.

The bobbin 30 is formed in a cylindrical shape, for example, and is disposed between the fixed core 26 and the holder 32. An engagement pin 36 (see FIG. 2), which is engaged with another end of an amplifying member 56, is formed on the proximal end side (in the direction of the arrow A) of the bobbin 30. Further, on an outer circumferential side of the bobbin 30, the coil 28 is wound in a radially inward recessed cavity, and a second signal transmitting member 72 that makes up the later-described signal transmitting unit 24 is disposed on the outer circumferential side of the coil 28. The engagement pin 36 is disposed at a position on the side of a coupler 44 of the later-described resin mold portion 14, in a circumferential direction of the cylindrical bobbin 30.

Ends of the coil 28 extend to the proximal end side (in the direction of the arrow A) of the bobbin 30, and are connected respectively to ends of a pair of drive terminals 38 that are incorporated in the later-described resin mold portion 14. In addition, by the coil 28 being supplied with electric current from non-illustrated connectors through the drive terminals 38, the coil 28 is excited and a magnetic force is generated. As a result, under a magnetic excitation action of the coil 28 in the housing 12, the non-illustrated movable core is displaced inside the bobbin 30, a valve element (not shown) disposed in the fuel injector 18 is attracted, and a valve open condition is brought about.

Further, on a proximal end outer circumferential surface of the holder 32, a radially inward recessed annular second groove 40 is formed, and the later-described resin mold portion 14 is engaged therein.

The resin mold portion 14, for example, is formed on the outer circumferential side of the housing 12 by being molded from a resin material. The resin mold portion 14 includes a main body section 42, which is formed in a cylindrical shape, a coupler 44 that projects out sideways from the proximal end of the main body section 42, and a connector 46 that interconnects the main body section 42 and the coupler 44.

Figure 2:
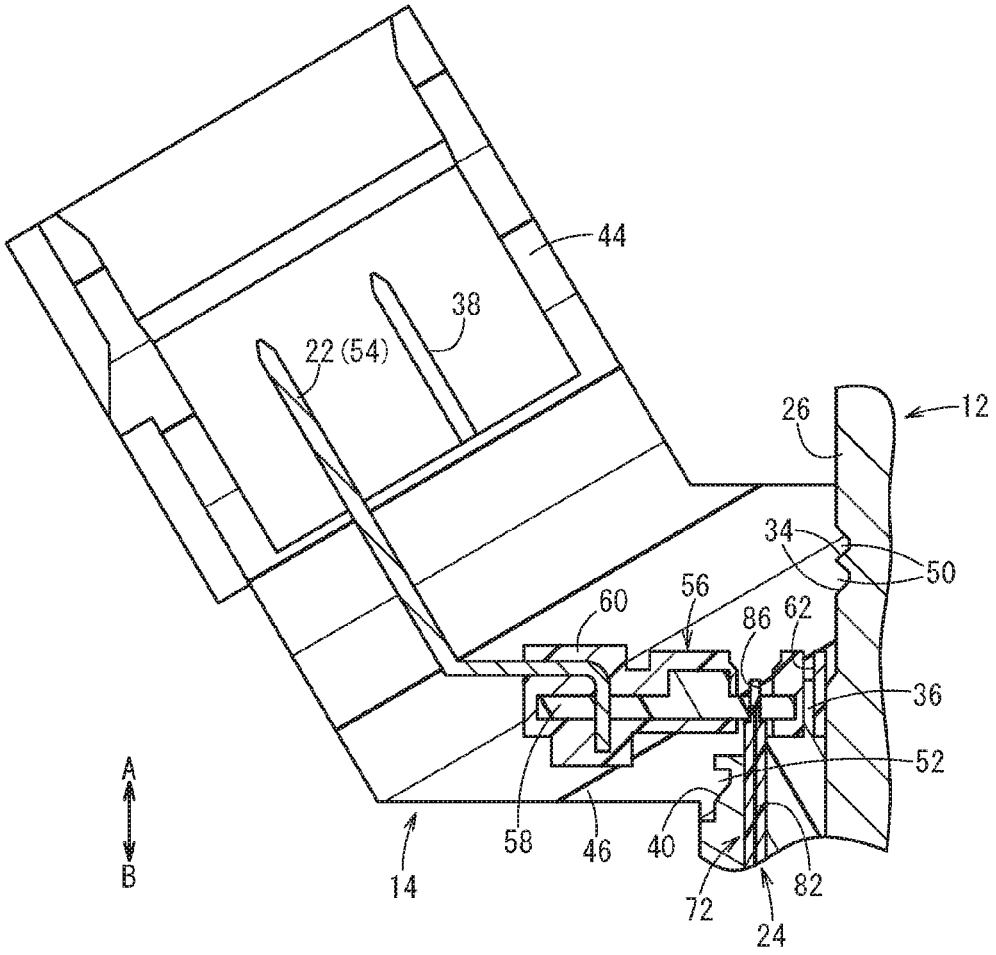
FIG. 2 is an enlarged cross-sectional view showing the vicinity of a coupler in the fuel injection valve equipped with the cylinder internal pressure sensor of FIG. 1.

In addition, by the resin mold portion 14 being molded by the resin material, the molten resin material enters respectively into the first grooves 34 of the fixed core 26 disposed in the center of the main body section 42, and the second groove 40 of the holder 32 disposed on the distal end side of the main body section 42, whereby under an engaging action between the radially inwardly projecting first and second protrusions 50, 52 and the first and second grooves 34, 40, the housing 12 is fixed with respect to the center and the distal end of the resin mold portion 14 (see FIG. 2).

Figure 4:
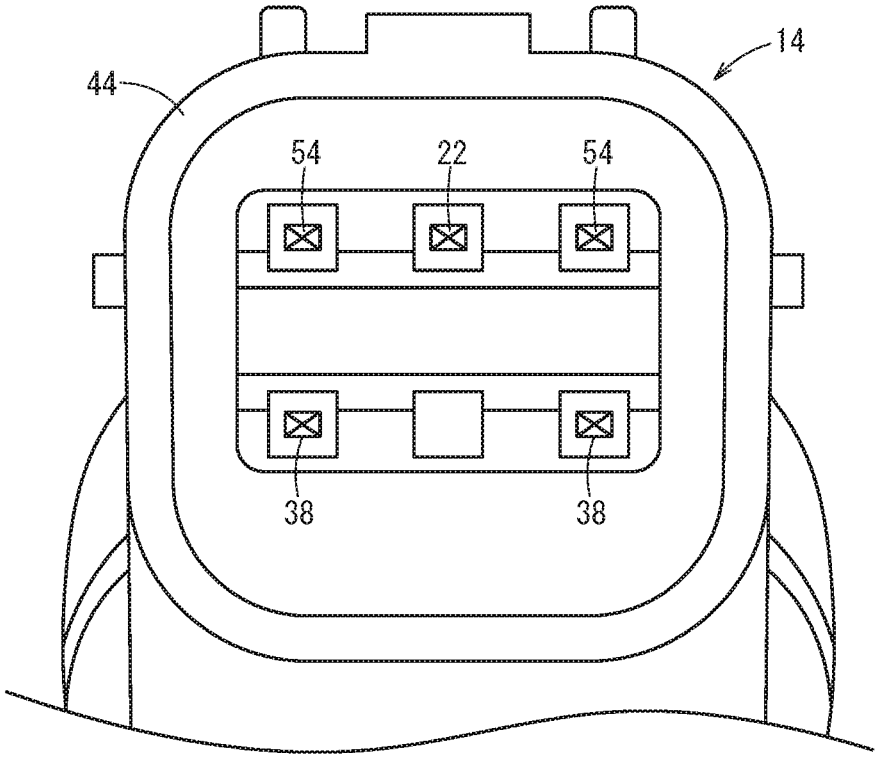
FIG. 4 is a front view in which the vicinity of the coupler of FIG. 2 is seen from the side of the power source terminals and the signal terminal.

As shown in FIGS. 1, 2, and 4, the coupler 44 is formed, for example, with a rectangular shape in cross section, and projects in an obliquely upward direction, so as to be inclined at a predetermined angle with respect to the axial direction (the direction of arrows A and B) of the main body section 42. Further, an end of the coupler 44 is opened and includes a space in the interior thereof, with power source terminals 54 and a signal terminal 22 of the later-described amplifying member (amplifying unit) 56, and the pair of drive terminals 38 for energizing the coil 28 being provided in an outwardly exposed manner therein, respectively.

Figure 3:
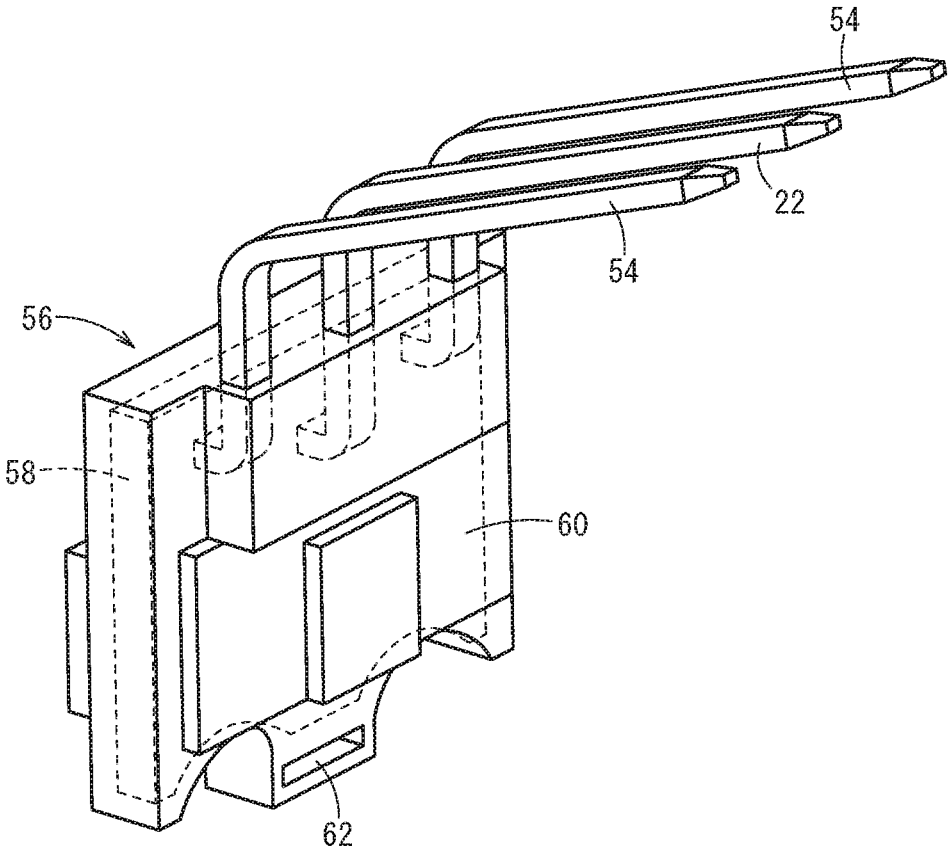
FIG. 3 is an external perspective view of an amplifying member that is incorporated in the fuel injection valve equipped with the cylinder internal pressure sensor of FIG. 1.

As shown in FIGS. 1 through 3, the amplifying member 56, for example, is disposed in the interior of the resin mold portion 14. The amplifying member 56 includes a substrate 58 with a rectangular cross section, the power source terminals 54 and the signal terminal 22 that are connected electrically to the substrate 58, and a sealing member 60, which is formed so as to cover the entirety of the substrate 58. The amplifying member 56 is provided with the aim of amplifying a detection value (detection signal) detected by the sensor 20, and outputting the amplified detection value from the signal terminal 22 to external.

Concerning the power source terminals 54 and the signal terminal 22, as shown in FIGS. 3 and 4, for example, the signal terminal 22 is arranged substantially in the center in the transverse direction of the substrate 58, and the pair of power source terminals 54 are arranged on both sides of the signal terminal 22. In this state, the ends of the power source terminals 54 and the signal terminal 22 are connected electrically with respect to the substrate 58 by solder or the like, and the power source terminals 54 and the signal terminal 22 extend at a predetermined angle of inclination with respect to an end portion of the substrate 58. More specifically, the two power source terminals 54 are arranged with respect to the substrate 58 so as to sandwich the signal terminal 22 between the pair of power source terminals 54.

The sealing member 60 is formed, for example, from a resin material. In a state in which the ends of the power source terminals 54 and the signal terminal 22 are connected with respect to the substrate 58, the sealing member 60 is formed so as to cover at a predetermined thickness the entirety of the substrate 58, and to cover the ends of the power source terminals 54 and the signal terminal 22 that are connected to the substrate 58. Consequently, the connection of the power source terminals 54 and the signal terminal 22 with respect to the substrate 58 is strongly maintained by the sealing member 60.

Further, in the sealing member 60, an engagement hole 62 is formed with a rectangular shape in cross section, which penetrates through the sealing member 60 in a thickness direction, on an end thereof on an opposite side from the end on the side of the power source terminals 54. The engagement pin 36 of the bobbin 30 that constitutes the housing 12 is capable of being inserted in the engagement hole 62.

In addition, when the resin mold portion 14 is formed, by insertion of the engagement pin 36 of the bobbin 30 into the engagement hole 62 of the sealing member 60, the substrate 58 and the sealing member 60 are placed in a position corresponding to the connector 46, and the power source terminals 54 and the signal terminal 22 are placed in a position corresponding to the coupler 44. Then, in the above positional relationship, the amplifying member 56 is molded integrally with the resin mold portion 14. Further, at the same time, an end of the amplifying member 56, which resides on an opposite side from the end where the power source terminals 54 are connected, is connected to the signal transmitting unit 24.

At this time, the proximal end sides of the power source terminals 54, the signal terminal 22, and the drive terminals 38 project out partially from an inner wall surface in the interior of the coupler 44, and as shown in FIGS. 1 and 2, the amplifying member 56 is arranged at a position between the first protrusions 50 and the second protrusion 52 of the resin mold portion 14 along the axial direction (the direction of arrows A and B) of the fuel injection valve 10.

By connecting a non-illustrated connector to the coupler 44, electrical power is supplied to the amplifying member 56 and the sensor 20 through the power source terminals 54, a detection value which is detected by the sensor 20 is output externally as an electric signal through the signal terminal 22, and electric current to energize the coil 28 of the housing 12 is supplied from the drive terminals 38.

The fuel supply unit 16, for example, includes a supply passage (not shown) through which fuel is supplied, in the interior of the fixed core 26, and a non-illustrated fuel pipe is connected to an end of the supply passage that opens on the proximal end side (in the direction of the arrow A) of the fuel injection valve 10. In addition, the fuel supplied through the fuel pipe passes through the supply passage, and is supplied to the side of the fuel injector 18 (in the direction of the arrow B) disposed on the distal end side.

As shown in FIG. 1, the fuel injector 18 comprises a valve housing 64 that is connected to a distal end of the housing 12, and a valve element (not shown) that is incorporated in the distal end of the valve housing 64. In addition, fuel is supplied from the fuel supply unit 16 into the interior of the valve housing 64, and by the valve element being moved toward the proximal end side (in the direction of the arrow A) upon excitation of the coil 28, fuel is injected from the distal end into the combustion chamber at a predetermined pressure.

The valve housing 64, for example, is formed from a metallic material. The valve housing 64 includes a flange 66 that closes the distal end of the housing 12, and a tubular portion 68 that extends along a straight line to the distal end side (in the direction of the arrow B) from the flange 66. The cylindrical sensor 20 is press-inserted and fitted on an outer circumferential side on the distal end of the tubular portion 68.

The sensor 20, for example, is equipped with a piezoelectric element (not shown) in the interior thereof, and connection terminals, which are connected to the piezoelectric element, are exposed on the proximal end side (in the direction of the arrow A). Further, a retaining portion 80 of a later-described cover member 78 abuts on the outer circumferential surface of the sensor 20. In addition, a distal end inner circumferential side of the sensor 20, for example, is coupled by being welded around the entire circumference with respect to the valve housing 64.

The signal transmitting unit 24 includes a first signal transmitting member (first transmitting member) 70 disposed on the outer circumferential side of the valve housing 64 and connected to the sensor 20, and a second signal transmitting member (first transmitting member) 72 accommodated in the holder 32 of the housing 12, and which connects the first signal transmitting member 70 and the signal terminal 22.

The first signal transmitting member 70, for example, includes an insulating body 74 formed in a cylindrical shape from a resin material, and which is disposed on the outer circumferential side of the tubular portion 68 in the valve housing 64, and a first conductive layer 76 disposed in the interior of the insulating body 74. In addition, the first conductive layer 76 is electrically connected, for example by solder or the like, to a connection terminal of the sensor 20.

The insulating body 74 is formed from a resin material such as a heat resistant resin or the like, and is formed such that the proximal end side thereof (in the direction of the arrow A) is expanded in diameter corresponding to the shape of the valve housing 64 so as to cover the tubular portion 68 and the flange 66. The first conductive layer 76, which is made up from a plating layer, for example, is formed in the center in the thickness along a diametrical direction of the insulating body 74, and the first conductive layer 76 is formed in a cylindrical shape along the insulating body 74 at a substantially constant thickness. A distal end of the insulating body 74 is press-inserted into the interior of the sensor 20 and around the tubular portion 68 of the valve housing 64.

On the other hand, on an outer circumferential side of the insulating body 74, a cover member 78, which is formed, for example, in a cylindrical shape from a metallic material, is mounted so as to cover the insulating body 74. The cover member 78 is formed such that the proximal end side thereof (in the direction of the arrow A) is expanded in diameter corresponding to the shape of the valve housing 64 so as to cover the tubular portion 68 and the flange 66. The retaining portion 80 that retains the outer circumferential surface of the proximal end side of the sensor 20 is formed on the distal end of the cover member 78.

The second signal transmitting member 72 is formed, for example, from a resin material, and is constituted in a plate shape having a predetermined length along the axial direction (the direction of arrows A and B), and a second conductive layer 82, which is formed from an electrically conductive material, is formed in the interior of the second signal transmitting member 72. The second conductive layer 82 is formed, for example, from a plating layer, which extends at a substantially constant thickness from the distal end to the proximal end along the axial direction (the direction of arrows A and B) of the second signal transmitting member 72.

A first connector 84, which projects in a perpendicular direction to the axial direction, is formed at the distal end of the second signal transmitting member 72. The first connector 84 is formed so as to face the proximal end of the first signal transmitting member 70. In addition, the first connector 84 is inserted into a recess or cavity of the first signal transmitting member 70. The second conductive layer 82, which is exposed in the cavity, and the first conductive layer 76 of the first signal transmitting member 70 are connected electrically by solder or the like.

On the other hand, a small diameter second connector 86, which is reduced in diameter with respect to the distal end side, is included on the proximal end of the second signal transmitting member 72. A portion of the second conductive layer 82 is exposed in an annular shape on the second connector 86 along the outer circumferential surface thereof. In addition, by the second connector 86 being inserted into a connecting hole formed in the substrate 58 of the amplifying member 56 and electrically connected to the hole by solder or the like, the second signal transmitting member 72 is connected electrically with the amplifying member 56.

Consequently, a condition is brought about in which the signal terminal 22 and the power source terminals 54 are connected electrically and mutually with the sensor 20 through the first and second signal transmitting members 70, 72.

The fuel injection valve 10 equipped with a cylinder internal pressure sensor according to the embodiment of the present invention is constructed basically as described above. Next, operations and advantageous effects of the fuel injection valve 10 will be described.

In a non-illustrated internal combustion engine during driving, by a control signal from the electronic control unit, the coil 28 is energized from the drive terminals 38 of the fuel injection valve 10, so that the coil 28 is excited. Then, the valve element of the fuel injector 18 is placed in a valve open state, and high pressure fuel, which is supplied to the supply passage of the fuel supply unit 16, is injected directly into the combustion chamber of the internal combustion engine through the fuel injector 18. At this time, by a pressure (cylinder internal pressure) in the combustion chamber being applied, the piezoelectric element of the sensor 20 generates a voltage corresponding to the pressure, which is output as a detection signal.

The detection signal is output to the amplifying member 56 via the sensor 20, the first signal transmitting member 70, and the second signal transmitting member 72, and after the detection signal has been amplified in the amplifying member 56, the detection signal is output to the electronic control unit through the signal terminal 22.

In addition, for example, in the electronic control unit, the pressure of the combustion chamber is calculated from the amplified output signal, and based on the calculated pressure, a combustion control or the like can be performed.

In the foregoing manner, according to the present embodiment, in the interior of the resin mold portion 14 in the fuel injection valve 10, the amplifying member 56 is disposed between the signal terminal 22 that is connected to the connector, and the signal transmitting unit 24 that is connected to the sensor 20. Thus, the detection signal detected by the sensor 20 is amplified by the amplifying member 56, and can be output to the electronic control unit from the signal terminal 22.

Therefore, even in the case that noise is generated due to vibrations or the like of the internal combustion engine, since it is possible for the detection signal to be amplified at the interior of the fuel injection valve 10 which is near to the sensor 20 and for which noise is comparatively small, a highly accurate detection signal can be obtained.

Further, since the signal terminal 22 is molded integrally in a state of being connected to the substrate 58 of the amplifying member 56, and the connection location of the signal terminal 22 is covered by the sealing member 60, the connection location can be protected.

Furthermore, the second connector 86 of the second signal transmitting member 72 is inserted into the connecting hole that is formed in the substrate 58 of the amplifying member 56, whereby the second signal transmitting member 72 can easily and reliably be connected electrically to the amplifying member 56. Therefore, ease of assembly between the amplifying member 56 and the signal transmitting unit 24 including the second signal transmitting member 72 can be enhanced.

Further still, when the resin mold portion 14 is formed, since the amplifying member 56 is molded integrally in the interior thereof, the amplifying member 56 can be protected, and water resistance and durability can be increased.

Still further, in the interior of the resin mold portion 14, the first protrusions 50, which are engaged with the first grooves 34 of the fixed core 26, and the second protrusion 52, which is engaged with the second groove 40 of the holder 32, are included, and the amplifying member 56 is arranged between the first protrusions 50 and the second protrusion 52. Therefore, even in the case that moisture penetrates into the interior of the resin mold portion 14, the first and second protrusions 50, 52 function as a sealing means, and infiltration of such moisture to the side of the amplifying member 56 can reliably be prevented.

The fuel injection valve equipped with the cylinder internal pressure sensor according to the present embodiment is not limited to the embodiment described above, and various additional or modified configurations may be adopted therein without departing from the scope of the present invention as set forth in the appended claims.

What is claimed is:

1. A fuel injection valve equipped with a cylinder internal pressure sensor, the fuel injection valve being configured to directly inject fuel into a combustion chamber of an internal combustion engine, the sensor being provided at an end of the fuel injection valve, the sensor being configured to detect a cylinder internal pressure in an interior of the combustion chamber, the fuel injection valve comprising:

a solenoid unit;

a resin sealing portion molding a portion of the solenoid unit;

a signal transmitting unit disposed in an interior of the fuel injection valve and configured to transmit a detection signal based on the cylinder internal pressure;

wherein the solenoid unit includes a coil and a pair of drive terminals connected to the coil, wherein the signal transmitting unit comprises:

a first transmitting member connected to the sensor;

a second transmitting member connected to the first transmitting member and configured to externally output the detection signal; and an amplifying unit disposed on the first transmitting member and configured to amplify the detection signal, wherein the amplifying unit is constituted as a circuit body in which a substrate is molded by a resin material, wherein the circuit body is connected to the second transmitting member and a power source terminal configured to supply electric current, and the circuit body and the drive terminals are incorporated in the resin sealing portion.

2. The fuel injection valve equipped with the cylinder internal pressure sensor according to claim 1, further comprising:

a housing having a fixed core, and a holder, the holder being disposed on an outer circumferential side of the fixed core and constituting a magnetic path;

wherein grooves are formed respectively in the fixed core and the holder, the grooves being configured to be engaged with the resin sealing portion, and the circuit body is disposed between one of the grooves and another of the grooves.

* * * * *